US011469546B2

(12) United States Patent
Kralik et al.

(10) Patent No.: US 11,469,546 B2
(45) Date of Patent: Oct. 11, 2022

(54) ELECTRICAL CONNECTOR SYSTEM

(71) Applicant: Western Technology, Inc., Bremerton, WA (US)

(72) Inventors: Michael Kralik, Bremerton, WA (US); Lyal Christensen, Bremerton, WA (US)

(73) Assignee: Western Technology, Inc., Bremerton, WA (US)

( * ) Notice: Subject to any disclaimer, the term of this patent is extended or adjusted under 35 U.S.C. 154(b) by 133 days.

(21) Appl. No.: 17/036,882

(22) Filed: Sep. 29, 2020

(65) Prior Publication Data

US 2022/0102908 A1 Mar. 31, 2022

(51) Int. Cl.
*H01R 13/53* (2006.01)
*H01R 13/17* (2006.01)
(Continued)

(52) U.S. Cl.
CPC ..... *H01R 13/53* (2013.01); *H01R 13/17* (2013.01); *H01R 13/2471* (2013.01); *H01R 13/71* (2013.01); *H01R 24/005* (2013.01)

(58) Field of Classification Search
CPC .... H01R 13/53; H01R 13/17; H01R 13/2471; H01R 13/22; H01R 13/24; H01R 13/2407;
(Continued)

(56) References Cited

U.S. PATENT DOCUMENTS 2,786,936 A 3/1957 Appleton
2,802,998 A 8/1957 Bauer
(Continued)

FOREIGN PATENT DOCUMENTS

CN 103682801 3/2014
CN 203553479 U 4/2014
(Continued)

OTHER PUBLICATIONS

Glenair Mission-Critical Interconnect Solution.: "Nuclear, Industrial, and Rail Power Connectors." Retrieved Feb. 10, 2020 from https://www.glenair.com/nuclear-industrial-and-rail-power-connectors/index.htm 14 Pages.

*Primary Examiner* — Travis S Chambers
(74) *Attorney, Agent, or Firm* — Thorpe North and Western LLP

(57) ABSTRACT

An electrical connector system can comprise a first connector and a second connector. The first connector can include a first threaded coupling feature defining a first axis. The first connector can also include a first electrical contact with a first contact surface having an annular configuration centered on the first axis by a radius. The second connector can include a second threaded coupling feature defining a second axis. The second connector can also include a second electrical contact with a second contact surface offset from the second axis by the radius. The first and second threaded coupling features can be operable to engage one another to couple the first and second connectors to one another such that the first and second axes are aligned, thereby facilitating contact or separation of the first and second contact surfaces upon relative rotation of the first and second connectors.

33 Claims, 4 Drawing Sheets

(51) Int. Cl.
*H01R 13/24* (2006.01)
*H01R 24/00* (2011.01)
*H01R 13/71* (2006.01)

(58) Field of Classification Search
CPC ..... H01R 13/2414; H01R 13/2421; H01R 13/2428; H01R 13/2464
See application file for complete search history.

(56) References Cited

U.S. PATENT DOCUMENTS

| | | | | |
|---|---|---|---|---|
| 3,915,536 | A | 10/1975 | Glantz | |
| 4,525,610 | A | 6/1985 | Le Magourou | |
| 4,796,159 | A | 1/1989 | Miksche | |
| 6,382,990 | B1 | 5/2002 | Marechal et al. | |
| 8,565,966 | B2 | 10/2013 | Langlais et al. | |
| 9,130,317 | B2 | 9/2015 | Wang et al. | |
| 9,130,319 | B2 | 9/2015 | Shimizu | |
| 10,734,769 | B2 * | 8/2020 | Kralik | H01R 13/631 |
| 2016/0072244 | A1 * | 3/2016 | Tien | H01R 39/64 439/18 |
| 2019/0140405 | A1 | 5/2019 | Kralik et al. | |

FOREIGN PATENT DOCUMENTS

| | | | |
|---|---|---|---|
| EP | 0295016 | A2 | 12/1988 |
| EP | 1032005 | | 8/2000 |
| GB | 1092197 | | 11/1967 |

* cited by examiner

ELECTRICAL CONNECTOR SYSTEM

BACKGROUND

Industrial environments (e.g., mining, paint and coatings, oil and gas, robotic manufacturing lines, high dust industrial environments, etc.) are governed by strict safety standards, such as 29 CFR 1910 and 29 CFR 1926 (April 2017). Associated equipment is regulated by safety standards, such as UL 1203 and UL 844, to prevent explosions due to sparks or arcing originating from electrical wires and connectors. For example, when a connector is energized during the uncoupling of the connector, arcing can occur between the electrical connectors as they disengage. If combustible conditions are present (e.g. sufficient dust, vapors, gases, etc.), as is often the case in industrial environments, this arcing can lead to an explosion. Safety standards typically specify permissible electrical wires and connectors including materials, flame paths (e.g., spark production), conductor separation distances, maximum gap distances, etc. A variety of connectors have been designed that meet the applicable safety standards. Despite compliance with such safety standards, however, there is room for improvement in connector designs to make connectors that are robust (e.g., fool-proof), reduced risk, and user friendly.

SUMMARY

An electrical connector system is disclosed herein that can meet safety standards by mechanical and physical isolation of connector contacts from surrounding environment as those contacts come into close proximity. In one aspect, the electrical connector system can facilitate safe connect/disconnect while energized by mechanically severing power within the connector upon disconnect and therefore no need to de-energize the lines when connecting/disconnecting. The electrical connector system can comprise a first connector and a second connector. The first connector can include a first threaded coupling feature defining a first axis. The first connector can also include a first electrical contact with a first contact surface having an annular configuration centered on the first axis by a radius. The second connector can include a second threaded coupling feature defining a second axis. The second connector can also include a second electrical contact with a second contact surface offset from the second axis by the radius. The first and second threaded coupling features can be operable to engage one another to couple the first and second connectors to one another such that the first and second axes are aligned, thereby facilitating contact or separation of the first and second contact surfaces upon relative rotation of the first and second connectors.

An electrical connector is also disclosed that can comprise a first connector including a first threaded coupling feature defining an axis. The electrical connector can also comprise a first electrical contact with a first contact surface having an annular configuration centered on the axis by a radius. The first threaded coupling feature can be operable to engage a second threaded coupling of a second connector to couple the first and second connectors to one another to facilitate contact or separation of the first electrical contact and a second electrical contact associated with the second connector upon relative rotation of the first and second connectors.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
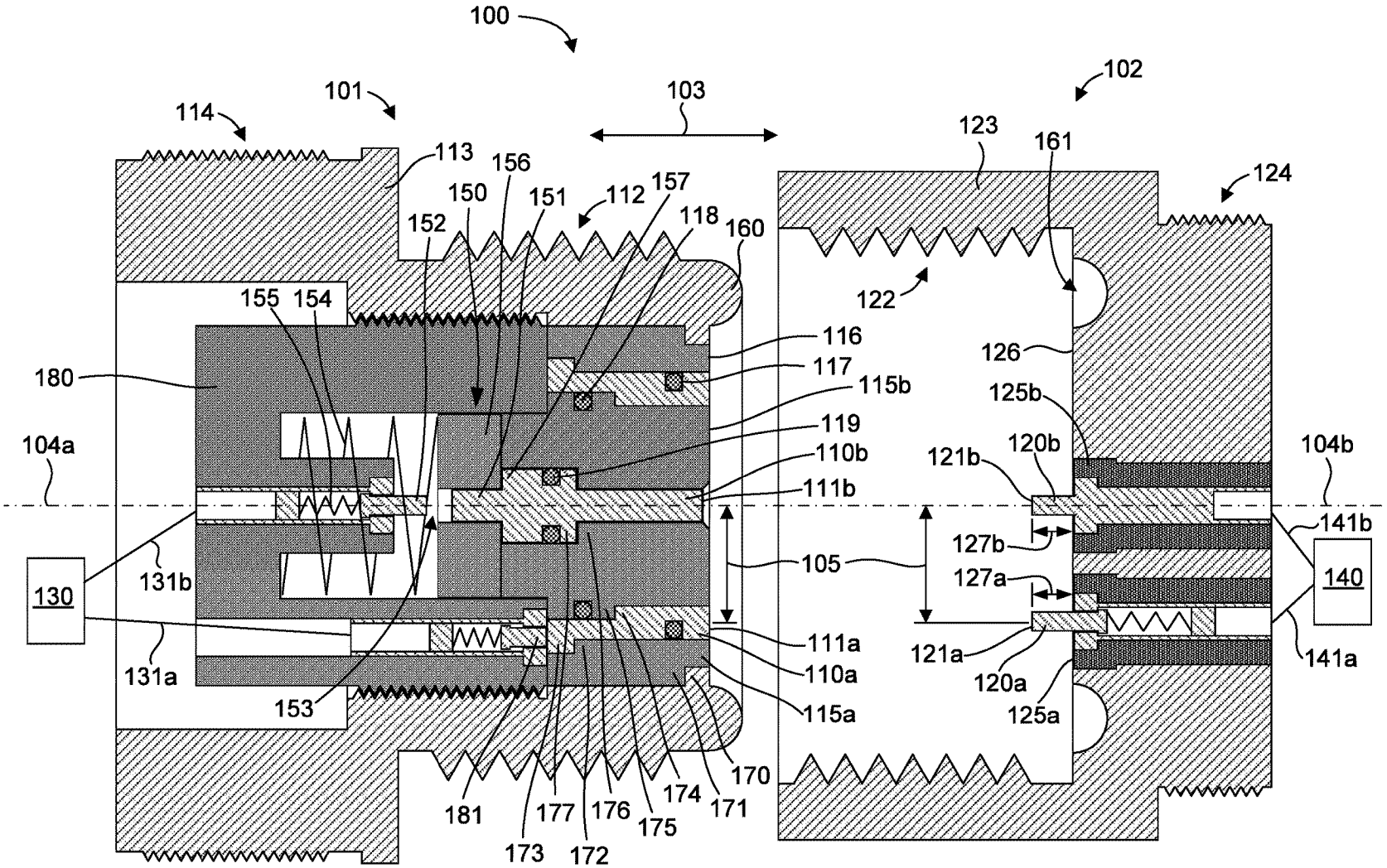
FIG. 1 is a side cross-sectional view of an electrical connector system prior to engagement in accordance with an example of the present disclosure.

These drawings are provided to illustrate various aspects of the invention and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Definitions

In describing and claiming the present invention, the following terminology will be used.

The singular forms "a," "an," and "the" include plural referents unless the context clearly dictates otherwise. Thus, for example, reference to "an electrical contact" includes reference to one or more of such features and reference to "engaging" refers to one or more of such steps.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, the term "about" is used to provide flexibility and imprecision associated with a given term, metric or value. The degree of flexibility for a particular variable can be readily determined by one skilled in the art. However, unless otherwise enunciated, the term "about" generally connotes flexibility of less than 2%, and most often less than 1%, and in some cases less than 0.01%.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

As used herein, the term "at least one of" is intended to be synonymous with "one or more of." For example, "at least one of A, B and C" explicitly includes only A, only B, only C, or combinations of each.

Numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Electrical Connector System

Figure 2A:
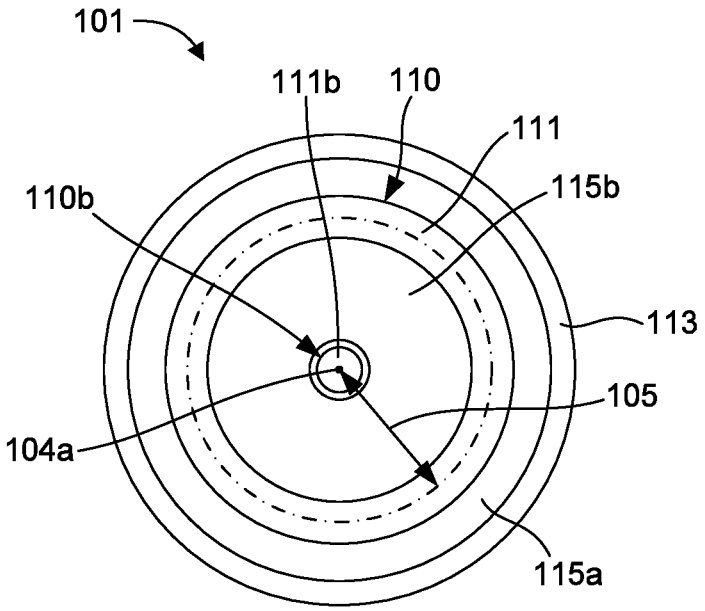
FIGS. 2A and 2B are detailed end views of complementary connectors of the electrical connector system of FIG. 1 in accordance with an example of the present disclosure.
Figure 2B:
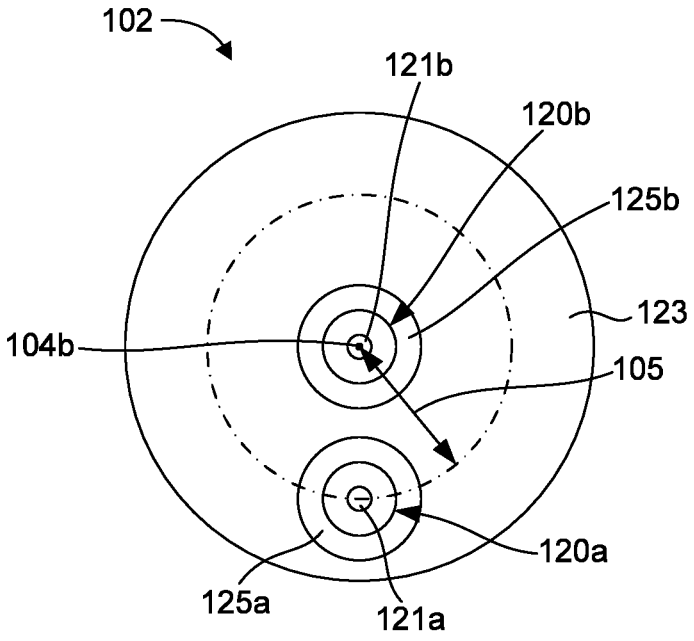

With reference to FIG. 1, an electrical connector system 100 is illustrated in accordance with an example of the present disclosure. The connector system 100 can include complementary connectors 101, 102. The connector 101 can include electrical contacts 110*a*, 110*b*, while connector 102 can include electrical contacts 120*a*, 120*b*. FIG. 1 shows the connectors 101, 102 in a disconnected or uncoupled state where the connectors and corresponding electrical contacts are remote and spaced from one another. FIGS. 2A and 2B illustrate detailed end views of the connectors 101, 102, respectively, that show electrical contacts and related structures of the connectors. The connectors 101, 102 can engage one another in an axial direction 103 (i.e., parallel to aligned axes 104*a*, 104*b* of the respective connectors 101, 102) to form an electrical connection or coupling of the respective electrical contacts 110*a-b*, 120*a-b* as shown in FIGS. 3A-3D and discussed in more detail below.

The electrical contacts 110*a-b*, 120*a-b* can be associated with or coupled to any suitable conductor of an electrical power line. For example, the corresponding electrical contacts 110*a*, 120*a* and the corresponding electrical contacts 110*b*, 120*b* can be associated with positive or negative of electrical power lines and can therefore be referred to as positive or negative contacts, as applicable. In a particular example, the electrical contacts 110*a*, 120*a* are corresponding positive contacts, and the electrical contacts 110*b*, 120*b* are corresponding negative contacts. Alternatively, the electrical contacts 110*a*, 120*a* are corresponding negative contacts, and the electrical contacts 110*b*, 120*b* are corresponding positive contacts. In some examples, the corresponding pairs of electrical contacts can be associated with supply, common, and/or neutral power lines, as applicable. Although two corresponding electrical contacts (i.e., pairs) are shown in the illustrated embodiment, it should be recognized that a connector system in accordance with the present disclosure can include any suitable number of electrical contacts as desired to adequately couple the number and type of conductors in a given electrical power line. For example, an additional pair or pairs of electrical contacts (not shown) can be included to facilitate use of the connector system with supply, common, and/or neutral power lines and/or a ground conductor of an electrical power line. Such additional pairs of contacts can be configured similar to the electrical contacts 110*a*, 120*a*, which are described in more detail below.

In the example illustrated in FIG. 1, the connector 101 can be associated with a power source 130 (e.g., a battery) and the connector 102 can be associated with an electrical load 140 (e.g., a light). Alternatively, the connector 101 can be associated with the electrical load 140 and the connector 102 can be associated with the power source 130. The power source 130 and the electrical contacts 110*a*, 110*b* can be connected by respective lines 131*a*, 131*b*. The electrical load 140 and the electrical contacts 120*a*, 120*b* can be connected by respective lines 141*a*, 141*b*. The lines 131*a*, 141*a* and 131*b*, 141*b* can be corresponding positive or negative power lines if the power source is a battery or other DC power source.

In one aspect, the connector 101 can include a threaded coupling feature 112 that defines the axis 104*a*, and the connector 102 can include a threaded coupling feature 122 that defines the axis 104*b*. The electrical contact 110*a* can have a contact surface 111*a* that has an annular configuration centered on the axis 104*a* by a radius 105 (see FIGS. 1 and 2A). The electrical contact 120*a* can have a contact surface 121*a* offset from the axis 104*b* by the radius 105 (see FIGS. 1 and 2B). The electrical contact 110*b* can have a contact surface 111*b* located on the axis 104*a* (see FIGS. 1 and 2A). The electrical contact 120*b* can have a contact surface 121*b* located on the axis 104*b* (see FIGS. 1 and 2B). The threaded coupling features 112, 122 can be operable to engage one another to couple the connectors 101, 102 to one another such that the axes 104*a*, 104*b* are aligned. This can facilitate contact or separation of the contacts 110*a*, 120*a* (e.g., the contact surfaces 111*a*, 121*a*) and the contacts 110*b*, 120*b* (e.g., the contact surfaces 111*b*, 121*b*) upon relative rotation of the connectors 101, 102 about the axes 104*a*, 104*b*. In other words, engagement of the threaded coupling features 112, 122 can advance or retract the contact surfaces 111*a*, 121*a* and the contact surfaces 111*b*, 121*b* relative to one another in the direction 103 as the connectors 101, 102 are rotated about the axes 104*a*, 104*b*. The contacts 110*b*, 120*b* are centrally located on the axes 104*a*, 104*b*. In contrast, the contacts 110*a*, 120*a* are offset from the axes 104*a*, 104*b*. The contact surface 111*a* can have an annular configuration that is continuous about the axis 104*a*. On the other hand, the contact surface 121*a* can be a relatively small, discrete surface. Because the contact surfaces 111*a*, 121*a* are offset from the axes 104*a*, 104*b* by the same radius 105, the discrete contact surface 121*a* can engage the continuous annular contact surface 121*a* at any given angular position about the aligned axes 104*a*, 104*b* as the connectors 101, 102 are rotated relative to one another in threaded engagement of the threaded coupling features 112, 122.

In one aspect, the connector 101 can be configured as a plug and the connector 102 can be configured as a socket that receives the plug. For example, the threaded coupling feature 112 can be configured as an external or male thread and the threaded coupling feature 122 can be configured as an internal or female thread. The threaded coupling features disclosed herein (e.g., the threaded coupling features 112, 122) can comprise any suitable thread form known in the art, such as a unified thread standard (UTS) thread form, an ISO metric standard thread form, a square thread form, an ACME thread form, a buttress thread form, etc. In some examples, the threaded coupling features 112, 122 can be formed in respective body portions 113, 123 of the connectors 101, 102. In one aspect, the body portions 113, 123 can be configured to couple with or otherwise be attached to other structures or devices that may be associated with or include the connectors 101, 102. For example, the body portion 113 can include a threaded coupling feature 114 operable to couple with a housing (not shown) for the power source 130, and the body portion 123 can include a threaded coupling feature 124 operable to couple with a housing (not shown) for the electrical load 140.

The electrical contacts 110*a-b*, 120*a-b* can have any suitable configuration in accordance with the principles disclosed herein. For example, the electrical contacts 110*a-b*, 120*a-b* can include a pin, a pogo pin, a receptacle, a landing, a pad, etc. alone or in any combination, as applicable. In the illustrated embodiment, the electrical contacts 110*a*, 120*b* can be fixed relative to the respective body portions 113, 123. In particular, the electrical contact 110*a* can comprise a fixed annular ring and the electrical contact 120*b* can comprise a fixed pin. On the other hand, the electrical contacts 110*b*, 120*a* can be movable relative to the respective body portions 113, 123. In particular, the electrical contacts 110*b*, 120*a* can comprise pogo pins (i.e., spring-loaded pins). The pogo pins can move in the direction 103 parallel to the axes 104*a*, 104*b* of the connectors 101, 102. The pin heads or contact surfaces can have any suitable shape or configuration, such as rounded (e.g., semi-spherical), flat, pointed, etc. In one aspect, fixed or movable (e.g., pogo pin) contacts can be flush or recessed with respect to facing surfaces 116, 126 of the respective connectors 101, 102. For example, the fixed contact 110*a* can have a flat contact surface 111*a* flush or (slightly) recessed with respect to the facing surface 116. The movable contact pin 110*b* can have a flat contact surface flush or (slightly) recessed with respect to the facing surface 116. In another aspect, fixed or movable contacts can protrude with respect to the facing surfaces 116, 126. For example, the movable contact pin 120*a* can have a contact surface 121*a* that protrudes with respect to the facing surface 126. In addition, the fixed contact pin 120*b* can have a contact surface 121*b* that protrudes with respect to the facing surface 126. Protruding contacts or pins can have any suitable protrusion length from the facing surfaces 116, 126. For example, the protruding pins 120*a-b* can protrude from the facing surface 126 by protrusion lengths 127*a-b*, respectively.

The contact surfaces 111*a*, 121*a* can have any suitable configuration to facilitate effective contact in accordance with the principles disclosed herein. For example, the contact surface 111*a* can be oriented non-parallel to the axis 104*a* and/or the contact surface 121*a* can be oriented non-parallel to the axis 104*b*. In a particular aspect, the contact surface 111*a* can be oriented perpendicular to the axis 104*a* and/or the contact surface 121*a* can be oriented perpendicular to the axis 104*b*. In one aspect, the contact surface 111*a* and/or the contact surface 121*a* can have a planar configuration, a curved or rounded configuration, etc., although any suitable surface shape or geometry may be utilized for the interfacing contact surfaces 111*a*, 121*a*.

In one aspect, fixed and movable contacts can be configured to facilitate ease of cleaning and avoidance of debris build-up. For example, the flush or recessed contacts 110*a-b* and the facing surface 116 can provide a substantially flat surface that is easily cleaned and does not promote accumulation of debris. In addition, the protruding pins 120*a-b* can have protrusion lengths 127*a-b* configured to allow the pins 120*a-b* to be readily cleaned and avoid trapping or capturing debris. In one embodiment, the protruding pins 120*a-b* can be configured as stubs with minimal protrusion lengths 127*a-b*. As a general guideline, protrusion lengths 127*a-b* can vary from about 0.5 mm to 5 mm, and most often from 2 mm to 4 mm. The movable contacts 110*b*, 120*a* can provide any suitable range of motion or travel to accommodate a given distance between the facing surfaces 116, 126 and the protrusion lengths 127*a-b*. The movable contacts 110*b*, 120*a* can therefore provide a reliable electrical contact with the corresponding fixed contacts 110*a*, 120*b* when the connectors 101, 102 are coupled with one another.

The connectors 101, 102 can be constructed of any suitable material or materials (e.g., metal, polymer, composite, etc.). In some embodiments, one or both of the body portions 113, 123 can be constructed of a metal material (e.g., aluminum, copper, iron, nickel, etc. alone or in any combination). In such cases, the electrical contacts 110*a-b*, 120*a-b* can be separated from the metal material by electrically insulative liners or sleeves 115*a-b*, 125*a-b* disposed about and/or between the respective electrical contacts. In the case where electrical contacts are ground contacts, these contacts can be in contact with metal material of the connectors (e.g., metal body portions). The electrically insulative liners 115*a-b*, 125*a-b* can be constructed of any suitable material, such as a dielectric material (e.g., a suitable polymer). The electrical contacts 110*a-b*, 120*a-b* and the electrically insulative liners 115*a-b*, 125*a-b* can be coupled to one another in any suitable manner, such as threadedly coupled, adhesively coupled, slidably coupled, and/or configured to have an interference fit. In one aspect, seals 117-119 (e.g., O-rings) can be utilized between adjacent contacts and electrically insulated liners to prevent moisture and/or debris from entering the connector 101.

In one aspect, the pair of contacts 110*a*, 120*a* and the pair of contacts 110*b*, 120*b* can be differentially energized. For example, the contacts 110*a*, 120*a* can be configured to contact one another prior to the other contacts 110*b*, 120*b* contacting one another when the connectors 101, 102 are being connected with one another. In addition, the contacts 110*a*, 120*a* can disconnect from one another after the other contacts 110*b*, 120*b* disconnect from one another when the connectors 101, 102 are being disconnected from one another to prevent sparking. In one example, the protrusion lengths 127*a*, 127*b* of the contacts 120*a*, 120*b* can be equal. In this case, the contact surface 111*a* of the contact 110*a* can be flush with the facing surface 116 while the contact surface 111*b* of the contact 110*b* can be recessed below or behind than the facing surface 116. This can enable prior contact and earlier separation of the contacts 110*a*, 120*a* relative to the contacts 110*b*, 120*b* by a distance equal to the recess depth of the contact 110 below or behind the facing surface 116. In another example, the contact surfaces 111*a*, 111*b* of the contacts 110*a*, 110*b* can be in substantially the same longitudinal location along the axis 104*a*. In this case, the protrusion length 127*a* of the contact 120*a* can be greater than the protrusion length 127*b* of the contact 120*b* to enable prior contact and earlier separation of the contacts 110*a*, 120*a* relative to the contacts 110*b*, 120*b*.

In some embodiments, the connector system 100 can be configured to mechanically sever power when the connectors 101, 102 begin to be separated from one another. For example, the contact 110*b* can be associated with or configured as an interconnect mechanism 150 that provides electrical continuity when the connectors 101, 102 are fully engaged and severs electrical continuity when the connectors 101, 102 become disengaged or begin to be separated from one another. In most cases, the interconnect mechanism 150 can sever power with contact 110*b* until the connectors 101, 102 are sufficiently engaged to isolate the contacts as described in more detail herein. In one aspect, the connector 101 can supply power to the connector 102 (e.g., the connector 101 can be coupled to a power source for delivery to a power consuming device coupled to the connector 102). Thus, severing power in the connector 101 can sever power in both the connectors 101, 102.

The interconnect mechanism 150 can include interconnect contact pins 151, 152 that contact one another when the connectors 101, 102 are fully engaged, and separate from one another to sever electrical continuity when the connectors 101, 102 become disengaged or begin to be separated from one another. In other words, the interconnect contact pins 151, 152 can be normally open or electrically disconnected from one another by a gap 153, thus severing power in the connector 101 to provide safe handling of the connectors 101, 102 when disconnected. The interconnect contact 151 can be part of the same structure as the contact 110*b* and located on an end opposite the contact 110*b*. The interconnect contact 151 can be biased away from the interconnect contact 152, such as by a spring 154 acting on a slider block 156 that engages a shoulder 157 at a base of the interconnect contact 151. In one aspect, the spring 154 can be a relatively high strength spring with a spring constant greater than or equal to about 13 N/m and less than or equal to about 33 N/m. The spring 154 can provide adequate resistance to a user assembling the connectors 101, 102 to ensure that an electrical connection is only made deliberately by the user. In addition, the interconnect contact 152 can be biased toward the interconnect contact 151, such as by a spring 155 acting on an end of the interconnect contact 152. Upon contact of the movable contact 110*b* with the fixed contact 120*b* due to movement of the connectors 101, 102 toward one another, the interconnect contact 151 begins to move toward the interconnect contact 152. Once contact is made between the interconnect contacts 151, 152, there is electrical continuity through the contact 110*b*. The spring-loaded interconnect contact 152 can accommodate additional movement of the interconnect contact 151 against the interconnect contact 152, such as due to additional movement of the connectors 101, 102 toward one another. When the connectors 101, 102 move away from one another, movement of the fixed contact 120*b* away from the connector 101 allows the biased interconnect contact 151 to move away from the interconnect contact 152 once the interconnect contact 152 has biased against its travel stop. When the interconnect contacts 151, 152 separate from one another there is electrical discontinuity in the contact 110*b*, thus severing power in the connector 101. Because the connector 102 is not coupled to a power source and power is severed within the connector 101, the connectors 101, 102 are safe and unable to generate sparks or arcing when disconnected. Thus, the connector 100 can facilitate safe connect/disconnect of the connectors 101, 102 while power is "hot" with no need to de-energize the lines.

In one aspect, the interconnect mechanism 150 can be connected to a load control apparatus having an interconnect circuit that electrically uncouples an input load terminal to prevent power from reaching an output load terminal, such as the electrical contact 110*b* via the interconnect mechanism 150. As mentioned above, the electrical contacts 110*b*, 120*b* can be configured to contact one another after the other contacts have contacted one another and to separate from one another prior to separation of the other contacts. This can ensure that there is never a generated spark at the electrical contacts. The interconnect mechanism 150 can be associated with any suitable conductor (e.g., a positive and/or a negative conductor). In one specific example, positive contacts can contact one another prior to negative contacts contacting one another upon assembly of the connectors 101, 102.

Although illustrated having a single annular contact surface, multiple concentric contact surfaces can be used in some cases. Similarly, two or more moveable pin contacts can be used. Such pin contacts can be energize and contacted simultaneously, or sequentially. For example, relative pin height can be varied in an unengaged position so that the pins are contacted and then pushed into an energized position at different stages of engagement. Alternatively, complementary receiving contacts (i.e. including annular contacts) can be oriented at varying depths on a connector end surface.

In some embodiments, the connector system 100 can include an annular protrusion 160 associated with the connector 101, and an annular recess 161 associated with the connector 102. The annular protrusion 160 and the annular recess 161 can be configured to interface with one another when the connectors 101, 102 are fully engaged. The annular protrusion 160 and recess 161 can serve to further isolate the contacts upon assembly or connection of the connectors 101, 102, as described in more detail below. In one aspect, the annular protrusion 160 can also provide a form of protection for the exposed contacts 110*a*, 110*b* and facing surface 116 of the connector 101 when disconnected from the connector 102. The annular protrusion 160 and recess 161 can have any suitable complementary cross-sectional shapes, such as semispherical cross-sectional shapes (as in the illustrated example). Although the annular protrusion 160 is illustrated associated with the connector 101 and the annular recess 161 associated with the connector 102, it should be recognized that the annular protrusion 160 can be associated with the connector 102 and the annular recess 161 can be associated with the connector 101. In one alternative, an electrical contact, such as an earth ground, may be located in recess 161, as an early contact for spark suppression. Alternatively, the recess can also be the controlling flame path, so as to avoid utilizing the threads for this purpose. In another option, a gasket can be inserted into recess 161 providing either the primary or a secondary environmental seal. In still another alternative, the annular recess can include a locking ratchet type mechanism. In this case, once the engagement has been made, a permanent coupling is formed, or a retractable keyed mechanism can be oriented in the recess to allow for removal.

In one aspect, the connector 101 can include certain features that facilitate assembly of the connector. For example, the connector body 113 can include a flange 170 located near the front of the connector 101 (e.g., at the end with the facing surface 116). The electrically insulative liner 115*a* can include a shoulder 171 configured to engage the flange 170 to locate the electrically insulative liner 115*a* relative to the connector body 113. The electrically insulative liner 115*a* can include a shoulder 172, and the annular contact 110*a* can include a shoulder 173 configured to engage the shoulder 172 to locate the annular contact 110*a* relative to the electrically insulative liner 115*a*. The annular contact 110*a* can include a shoulder 174, and the electrically insulative liner 115*b* can include a shoulder 175 configured to engage the shoulder 174 to locate the electrically insulative liner 115*b* relative to the annular contact 110*a*. The electrically insulative liner 115*b* can include a shoulder 176, and the contact 110*b* can include a shoulder 177 configured to engage the shoulder 176 to locate the contact 110*b* relative to the electrically insulative liner 115*b*. An electrically insulative cap 180 can be configured to support the spring 154 and the interconnect contact 152, with the slider block 156 engaged with the shoulder 157. The electrically insulative cap 180 and the connector body 113 can be threadingly engaged to secure the various contacts and electrically insulative liners. A movable contact 181 (e.g., a spring-loaded contact such as a pogo pin) can be associated with the electrically insulative cap 180. The movable contact 181 can be configured to engage a back side the annular contact 110*a* as the electrically insulative cap 180 and the connector body 113 are threadably coupled to one another. The movable contact 181 can move upon contact with the annular contact 110*a* to enable fully "tightening" the assembly in a manner similar to the interaction of the annular contact 110*a* with the movable contact 120*a* described above.

Figure 3A:
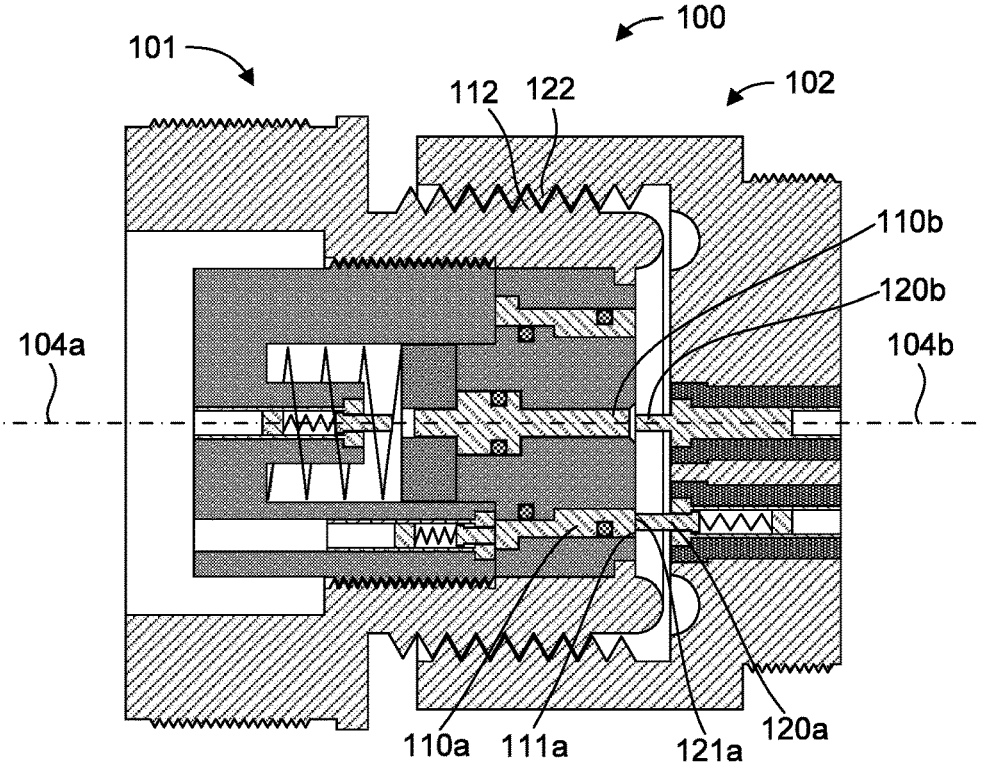
FIGS. 3A-3D illustrate stages of engagement for connectors of the electrical connector system of FIG. 1.

With further reference to FIGS. 1 and 2, FIGS. 3A-3D illustrate connecting or coupling the connectors 101, 102 of the connector system 100. As shown in FIG. 3A, the connectors 101, 102 can be moved toward one another by the threaded engagement of the threaded coupling features 112, 122 and the connectors 101, 102 rotating about the axes 104*a*, 104*b* relative to one another until the contact surfaces 111*a*, 121*a* of the respective contacts 110*a*, 120*a* contact one another. As shown in FIG. 3A, the contacts 110*a*, 120*a* can contact one another prior to contact of the other corresponding electrical contacts 110*b*, 120*b*. In addition to configuring appropriate protrusion lengths 127*a*-*b* (FIG. 1) and longitudinal contact positions, the threaded coupling features 112, 122 can be configured with a sufficiently tight fit to maintain a proper orientation of the connectors 101, 102 to one another (i.e., tilting the axes 104*a*, 104*b*) to ensure a consistent preferential order of engagement/disengagement of the corresponding electrical contacts.

Figure 3B:
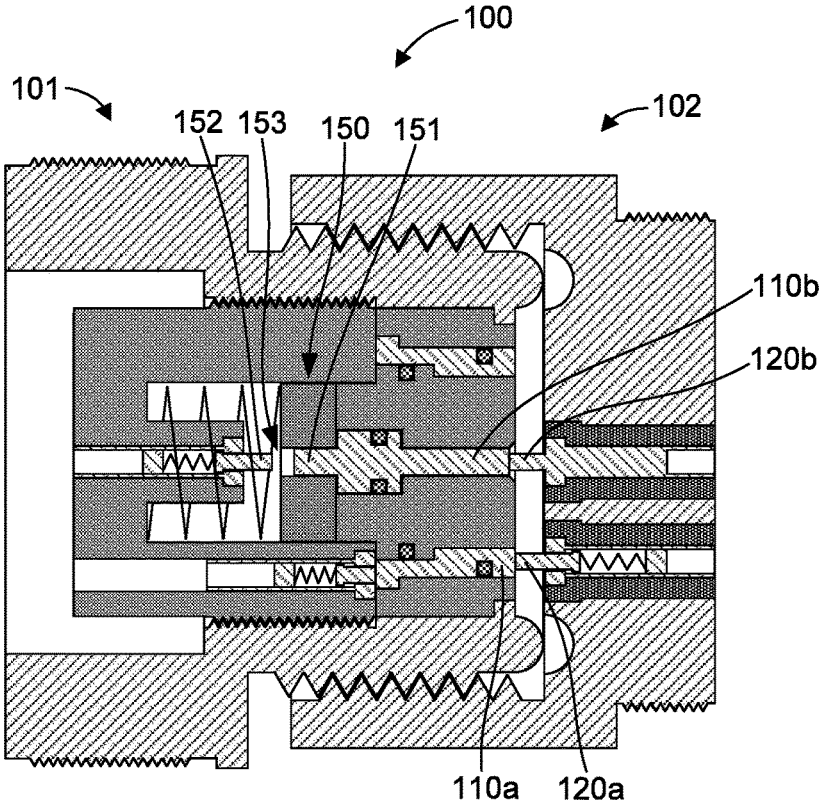
Figure 3C:
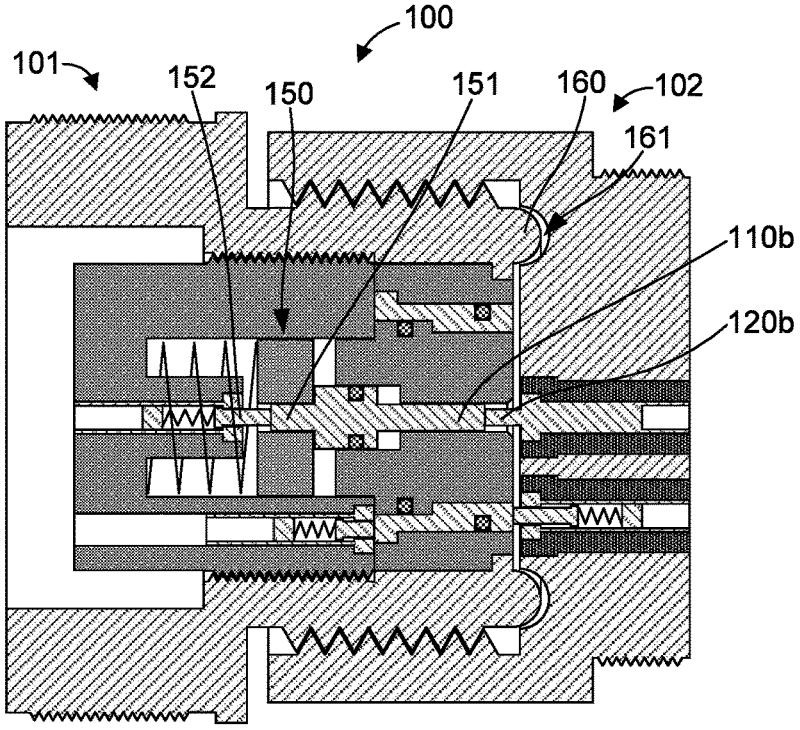
Figure 3D:
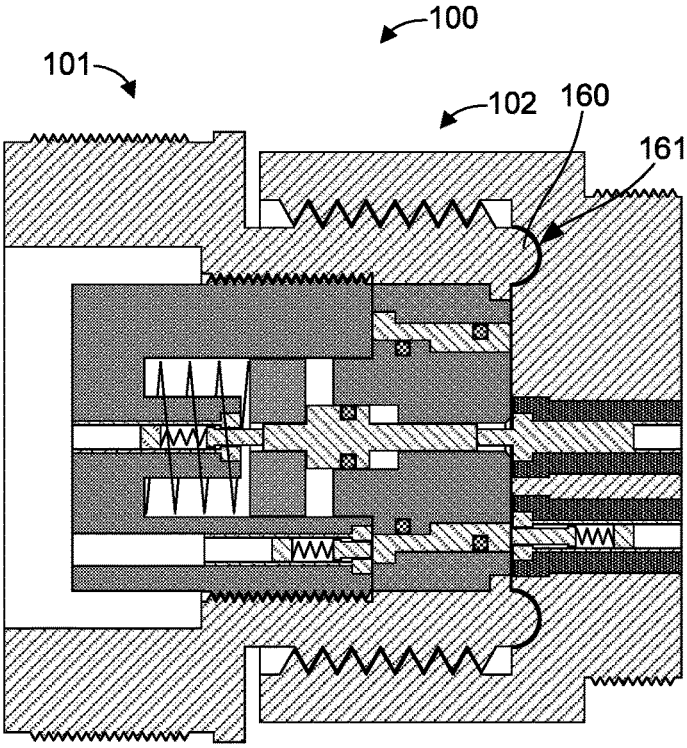

Following contact of the contacts 110*a*, 120*a*, the corresponding contacts 110*b*, 120*b* can contact one another, as shown in FIG. 3B. In some embodiments, the corresponding electrical contacts 110*b*, 120*b* can be configured to contact one another last and may be associated with or configured as an interconnect mechanism 150. At the point of contact between the corresponding electrical contacts 110*b*, 120*b*, as shown in FIG. 3B, there is no electrical continuity through the interconnect mechanism 150 due to the separation of the interconnect contacts 151, 152 via gap 153. By moving the connectors 101, 102 further toward one another, as shown in FIG. 3C, the interconnect contacts 151, 152 can contact one another and provide electrical continuity through the interconnect mechanism 150, thereby energizing the connection between the electrical contacts 110*b*, 120*b*. The annular protrusion 160 and recess 161 can be sufficient to safely isolate the electrical contacts from an external hazardous environment prior to engagement of the interlock mechanism 150 (e.g., contact of the interconnect contacts 151, 152). Thus, electricity does not flow through the connectors 101, 102, and therefore no potential for arcing or sparks, until the current carrying components are safely isolated from the external environment. The connectors 101, 102 can be further moved toward one another to interface the annular protrusion 160 and the annular recess 161, as shown in FIG. 3D. At this point the connectors 101, 102 are fully engaged and all the movable contacts are compressed and in contact with corresponding contacts.

The above-described process for connecting the connectors 101, 102 is generally reversed when disconnecting the connectors, which disconnects the various electrical connections formed during connection of the connectors. Thus, as the connectors 101, 102 begin to separate from one another, the interconnect contacts 151, 152 of the interconnect mechanism 150 can also separate from one another creating an electrical discontinuity in an energized line and thereby prevent sparks from occurring regardless of any space between contacts. The electrical contacts are therefore isolated from the exterior environment of the connector system 100 by the annular protrusion 160 and recess 161 until after the interconnect contacts 151, 152 have separated from one another with no flame or spark path existing to the exterior of the connector that could potentially ignite flammable material (e.g., gases). In addition, the electrical contacts 110*b*, 120*b* are separated from one another while the contacts 110*a*, 120*a* are still engaged with one another, with contacts 110*a*, 120*a* being the final contacts to separate to further avoid sparks or arcing. These features allow the connectors 101, 102 to be safely separated from one another in a hazardous area (e.g., an industrial environment) while energized. In addition, because the interconnect mechanism 150 mechanically severs power in the connector 101 that supplies power to the connector 102, the connectors are both safe after they have been separated from one another.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. An electrical connector system, comprising:

a first connector including a first threaded coupling feature defining a first axis, and a first electrical contact with a first contact surface having an annular configuration centered on the first axis by a radius, wherein the first connector further comprises a third electrical contact;

a second connector including a second threaded coupling feature defining a second axis, and a second electrical contact with a second contact surface offset from the second axis by the radius, wherein the first and second threaded coupling features are operable to engage one another to couple the first and second connectors to one another such that the first and second axes are aligned, thereby facilitating contact or separation of the first and second contact surfaces upon relative rotation of the first and second connectors, wherein the second connector further comprises a fourth electrical contact, and wherein the third and fourth electrical contacts being operable to contact or separate upon relative rotation of the first and second connectors; and an interconnect mechanism associated with the third electrical contact that provides electrical continuity when the first and second connectors are fully engaged and severs electrical continuity as the first and second connectors are disconnected.

2. The electrical connector system of claim 1, wherein the third electrical contact is located on the first axis, and the fourth electrical contact is located on the second axis.

3. The electrical connector system of claim 1, wherein the first and second electrical contacts are corresponding first and second positive contacts, and the third and fourth electrical contacts are corresponding first and second negative contacts.

4. The electrical connector system of claim 1, further comprising an annular protrusion associated with the first or second connector, and an annular recess associated with the other of the first or second connector, the annular protrusion and the annular recess being configured to interface with one another when the first and second connectors are fully engaged.

5. The electrical connector system of claim 1, wherein the first connector is configured as a plug and the second connector is configured as a socket that receives the plug.

6. The electrical connector system of claim 1, wherein the first contact surface is oriented non-parallel to the first axis.

7. The electrical connector system of claim 6, wherein the first contact surface is oriented perpendicular to the first axis.

8. The electrical connector system of claim 1, wherein the second contact surface is oriented non-parallel to the second axis.

9. The electrical connector system of claim 8, wherein the second contact surface is oriented perpendicular to the second axis.

10. The electrical connector system of claim 1, wherein the first and second electrical contacts contact one another prior to the third and fourth electrical contacts contacting one another when the first and second connectors are being connected with one another, and the first and second electrical contacts disconnect from one another after the third and fourth electrical contacts disconnect from one another when the first and second connectors are being disconnected with one another to prevent sparking.

11. The electrical connector system of claim 10, wherein the first electrical contact is fixed relative to the first connector, and the second electrical contact comprises a pogo pin.

12. The electrical connector system of claim 10, wherein the third electrical contact comprises a pogo pin, and the fourth electrical contact comprises a fixed pin.

13. The electrical connector system of claim 1, wherein the interconnect mechanism comprises a first interconnect contact and a second interconnect contact that contact one another when the first and second connectors are fully engaged, and separate from one another to sever electrical continuity when the first and second connectors are disconnected.

14. The electrical connector system of claim 13, wherein the first interconnect contact is spring-loaded and biased away from the second interconnect contact.

15. The electrical connector system of claim 14, wherein the second interconnect contact is spring-loaded and biased toward the first interconnect contact.

16. The electrical connector system of claim 1, wherein at least one of the first connector and the second connector is constructed of a metal material.

17. The electrical connector system of claim 16, wherein the first and second electrical contacts are separated from the metal material by electrically insulative material.

18. An electrical connector, comprising:

a first connector including a first threaded coupling feature defining an axis, and further comprising a third electrical contact;

a first electrical contact with a first contact surface having an annular configuration centered on the axis by a radius, wherein the first threaded coupling feature is operable to engage a second threaded coupling of a second connector to couple the first and second connectors to one another to facilitate contact or separation of the first electrical contact and a second electrical contact associated with the second connector upon relative rotation of the first and second connectors, and wherein the third electrical contact is operable to contact or separate a fourth electrical contact associated with the second connector upon relative rotation of the first and second connectors; and an interconnect mechanism associated with the third electrical contact that provides electrical continuity when the first and second connectors are fully engaged and severs electrical continuity as the first and second connectors are disconnected.

19. The electrical connector of claim 18, wherein the first electrical contact is fixed relative to the first connector.

20. The electrical connector of claim 18, wherein the third electrical contact is located on the axis.

21. The electrical connector of claim 18, wherein the third electrical contact comprises a pogo pin.

22. The electrical connector of claim 18, wherein the first contact surface is oriented non-parallel to the axis.

23. The electrical connector of claim 22, wherein the first contact surface is oriented perpendicular to the axis.

24. The electrical connector of claim 18, wherein the interconnect mechanism comprises a first interconnect contact and a second interconnect contact that contact one another when the first and second connectors are fully engaged, and separate from one another to sever electrical continuity when the first and second connectors are disconnected.

25. The electrical connector of claim 24, wherein the first interconnect contact is spring-loaded and biased away from the second interconnect contact.

26. The electrical connector of claim 25, wherein the second interconnect contact is spring-loaded and biased toward the first interconnect contact.

27. An electrical connector system, comprising:

a first connector including a first threaded coupling feature defining a first axis and a first electrical contact with a first contact surface having an annular configuration centered on the first axis by a radius, and further comprises a third electrical contact; and a second connector including a second threaded coupling feature defining a second axis, and a second electrical contact with a second contact surface offset from the second axis by the radius, and further comprises a fourth electrical contact, wherein the first and second threaded coupling features are operable to engage one another to couple the first and second connectors to one another such that the first and second axes are aligned, thereby facilitating contact or separation of the first and second contact surfaces upon relative rotation of the first and second connectors, and wherein the third and fourth electrical contacts are operable to contact or separate upon relative rotation of the first and second connectors, and wherein the first and second electrical contacts contact one another prior to the third and fourth electrical contacts contacting one another when the first and second connectors are being connected with one another, and the first and second electrical contacts disconnect from one another after the third and fourth electrical contacts disconnect from one another when the first and second connectors are being disconnected with one another to prevent sparking.

28. The electrical connector system of claim 27, wherein the first contact surface and the second contact surface are oriented non-parallel to the first axis.

29. The electrical connector system of claim 27, wherein the first contact surface and the second contact surface are oriented perpendicular to the first axis.

30. The electrical connector system of claim 27, wherein the third electrical contact is located on the first axis, and the fourth electrical contact is located on the second axis.

31. The electrical connector system of claim 27, wherein the first electrical contact is fixed relative to the first connector, and the second electrical contact comprises a pogo pin, and the third electrical contact comprises a pogo pin, and the fourth electrical contact comprises a fixed pin.

32. The electrical connector system of claim 27, further comprising an interconnect mechanism associated with the third electrical contact that provides electrical continuity when the first and second connectors are fully engaged and severs electrical continuity as the first and second connectors are disconnected.

33. The electrical connector system of claim 32, wherein the interconnect mechanism comprises a first interconnect contact and a second interconnect contact that contact one another when the first and second connectors are fully engaged, and separate from one another to sever electrical continuity when the first and second connectors are disconnected.

* * * * *